United States Patent [19]

Best

[11] 4,243,872

[45] Jan. 6, 1981

[54] ELECTRICAL HEATING ELEMENT

[75] Inventor: Lorne A. Best, West Bloomfield, Mich.

[73] Assignee: National Element, Inc., Troy, Mich.

[21] Appl. No.: 20,594

[22] Filed: Mar. 14, 1979

[51] Int. Cl.[3] ..... H05B 3/00

[52] U.S. Cl. ..... 219/375; 338/295; 338/299; 338/55; 338/318

[58] Field of Search ..... 174/138 J; 219/375, 219/532, 536, 537, 542, 550; 338/55, 58, 288, 289, 291, 296, 298, 299, 305, 304, 317, 318

[56] References Cited

U.S. PATENT DOCUMENTS

| | | | |
|---|---|---|---|
| 716,048 | 12/1902 | Jenkins | 338/299 |
| 834,424 | 10/1906 | Waters | 338/295 |
| 933,989 | 9/1909 | Johnson | 219/375 |
| 1,602,804 | 10/1926 | Wilkinson et al. | 219/550 |
| 2,106,462 | 1/1938 | Lindberg | 219/415 |
| 2,513,945 | 7/1950 | Kitto et al. | 219/375 |
| 2,565,769 | 8/1951 | Hatker | 219/369 |

*Primary Examiner*—Roy N. Envall, Jr.
*Assistant Examiner*—Bernard Roskoski
*Attorney, Agent, or Firm*—Cullen, Sloman, Cantor, Grauer, Scott & Rutherford

[57] ABSTRACT

An improved electrical heating element is constructed in such a manner as to increase the amount of electrical wire per unit space available for plug-type convection heating units. The plug uses a rectangular-shaped frame which has a plurality of spool covered rods evenly spaced along the length of the frames and extending across the width. The spools are slidably attached over the rods and have an insulated spacer on each side of the spool. The heating wire has alternate coiled and straight sections and is wound over and held to each spool by a retention wire and a groove in the spool. The rods are spaced at such a distance from each other that there is a straight section of heating wire at each spool with the coiled sections located between adjacent rods.

1 Claim, 6 Drawing Figures

ELECTRICAL HEATING ELEMENT

BACKGROUND OF THE INVENTION

The plug-type heating elements of the prior art consisted of a series of metal rectangular sections which have an insulator on each side of each section at a plurality of spaced locations along the length of the section. The electrical heating wire was wound around each of the spacers down one side of the frame and back up the opposite side of the frame.

One of the problems associated with the prior art heating element construction involves the space taken up by each frame member which space interferes with the flow of air through the plug unit. In other words, the heating elements when electrically connected provide a source of heat with the flow of air passing through and around the heat elements determining the quantity of heat emitted from the plug unit. If air flow is restricted by metal frame sections, the kilowatt output per unit area will be decreased causing loss of efficiency. Likewise, the use of multiple frame sections for a plug unit occupies a large percentage of the physical space which could be used for heating elements.

An additional drawback of the prior art is that the insulators which are attached to the frame sections are difficult to remove and each insulator must be removed from the frame section separately in order to change wire spacing or otherwise repair old plug units. Additionally, the cost of construction necessitated by the multiple frame sections and the attachment of each individual insulator to those frame sections grows increasingly with the cost of materials for the frames and insulators as well as the labor involved in assembling each plug unit.

Other examples of prior art use of electrical resistive elements do not solve the problems associated with plug type convection heating. For example, the patent to Eickemeyer, Jr. (U.S. Pat. No. 454,207) discloses an electrical resistor box which uses a frame structure A with a pair of rods M mounted thereon. Additionally, a plurality of spacers D are positioned along the rods with coil resistance elements E wound around the spacers between the rods M. However, Eickemeyer does not address itself to plug type convection heaters and its design is merely to provide a fire safe means for operating an electric elevator.

The patent of Jenkins (U.S. Pat. No. 716,048) discloses an electrical resistance heater comprising a frame-like casing H and including a pair of rods I, I′ mounted therein. A plurality of grooved insulators G are mounted on the rods to support a coil resistance element A therebetween. The Jenkins patent is used as an electrical heating element which is not related to plug type convection heaters and employs a core inside of the coil wound wire thereby cutting down on the air flow through the entire structure making the Jenkins heater inappropriate for the plug type convection heaters.

The patent to Wilkinson et al (U.S. Pat. No. 1,602,804) which discloses an electrical resistance heater comprising a pair of rods 12 and 14 which are supported by walls 2 has each rod supporting a plurality of grooved ceramic spacers 18 mounted thereon. A coil resistance element 22 is wound around the spacer 18 between the rods 12 and 14. The Wilkinson patent is not related to air flow convection type heaters and is primarily used as discussed in the patent in the form of electric toasters or other such appliances whose main object is radiated heat in a confined space.

Atkinson et al (U.S. Pat. No. 2,155,289) discloses an electrical resistance heating comprising a frame 1 and 2 which supports a pair of rods 3. The rods, in turn, support a plurality of grooved ceramic spools 7. A coil resistance element 8 is wound around the ceramic spools between the rods 3. The heater of Atkinson is not set up in a manner so as to provide for a plug type convection heating system and additionally the wire is continuously wound in a coil-shaped manner throughout the entire structure. The main purpose of the heater of Atkinson is to provide a radiating type of electrical space heater as shown in FIG. 7.

The patent to Weyenberg (U.S. Pat. No. 3,212,045) discloses a grid resistor comprising a pair of frame members 1 separated by a pair of threaded rods 2. Metallic resistance elements 5 are spaced apart by a plurality of insulated spacers 9 and sleeves 13 mounted around the rods 2. The Weyenberg heater uses a metallic resistance element 5 which is unrelated to coiled resistance wires and furthermore the design features of the grid resistance show that it is not meant to be used as a convection type of plug heating unit because of the shape of the resistive metallic elements.

The patents to Best (U.S. Pat. No. 4,016,403), Beck (U.S. Pat. No. 4,011,395), Paulson et al (U.S. Pat. No. 3,883,721), Dunlop (U.S. Pat. No. 1,726,476), Simmons (U.S. Pat. No. 1,698,282) and Colby (U.S. Pat. No. 1,335,483) generally show various types of open framework electrical resisting heating units which provide for adequate space heating but are not designed to alleviate the problems concerned with minimizing space to permit greater air flow thereby increasing the BTU output of plug type heater units.

SUMMARY OF THE INVENTION

The present invention is an improved electrical heating element for use in plug-type convection heaters. The heating element consists of a continuous electrical resistance heating wire having alternate coil wound and straight segments. A two-piece frame support structure consisting of two parallel and separate metal sides has a plurality of metal rods extending from the one side of the frame structure to the other side. The side frames and rods provide the boundaries for the continuous heating wire. A plurality of single groove ceramic spools are spaced along the metal rods with each of the spools being attached to one of the straight segments of the heating wire. A plurality of ceramic insulating spacers which are positioned along the metal rods are aligned with one of the spacers on each side of the spools.

The heating element of the present invention, with its reduction in the number of frame members needed to support the spool, provides an improvement in the power density input and output to the plug-type heater. As many spools as practicable can be inserted between the sides of the frame of the present invention thus eliminating air flow resistance due to an excessive number of frame members thereby permitting less pressure drop from the one end of the frame to the other. This reduction in pressure drops allows the air flow to be more continuous and permits a greater output of heated air from the plug unit.

The present invention with its spacers and spools being slidably retained on rods allows for ease of assembly and repairability because the rods may be simply pushed out and as many spacers or spools replaced or changed as desired. Also, the spacing interval may be changed by removing some of the rods or by increasing the number of rods in the frame structure.

The simplicity of construction and the ease with which the spaces and spools are able to be changed permits the stacking of several rows of spacers without inhibiting the air flow.

In another embodiment, the heating elements may be three-dimensional in that the coil members may be vertically placed in a saw-tooth pattern as the coil is stretched between two separate vertically and horizontally offset rows of frame members and rods. Once again, with this configuration the replacement of spacers and the repair of the heating elements is simplified as it is only necessary to remove either end of the rods which may be screw attached or simply push fitted into the sides of the frames.

The present invention also provides for reduced cost in the production of plug-type heaters in that the frame members which are usually metal may be substantially reduced in number from previous plug heating element members. Further, a time savings is accomplished by this construction as there is no requirement of fastening each individual insulator to a frame member as was the case in the prior art.

DETAILED DESCRIPTION

Figures 1, 2, 3, 4, 5, 6:
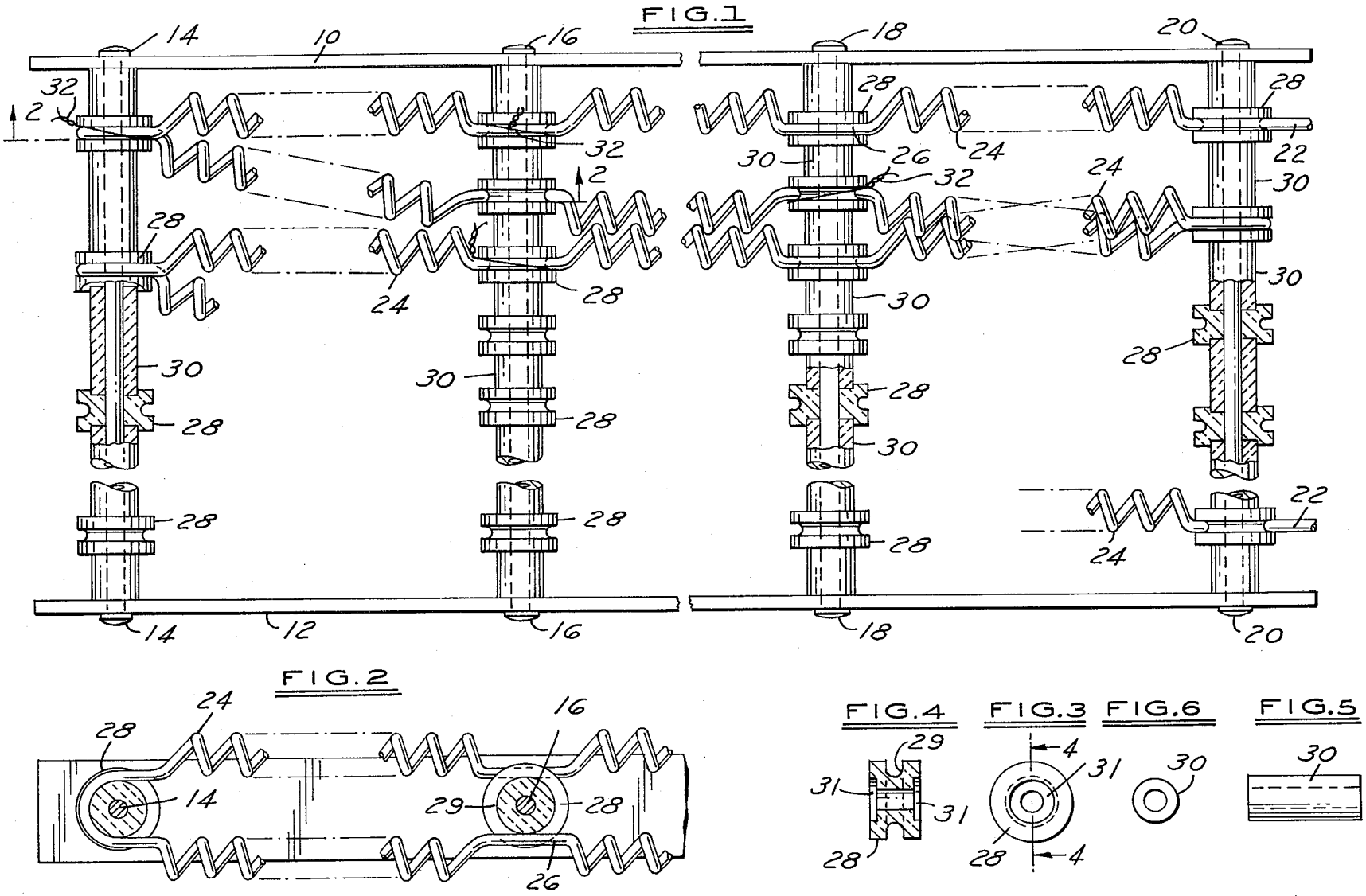
FIG. 1 illustrates in a partial cut-away view the heating element construction of the present invention.
FIG. 2 shows a side cut-away view of the heating element construction taken along lines 2—2 of FIG. 1.
FIG. 3 is a side view of the wire-retaining ceramic spool.
FIG. 4 is a cut-away view of the ceramic spool taken along lines 4—4 of FIG. 3.
FIG. 5 is a side view of the insulating spacer.
FIG. 6 is a front view of the insulating spacer of FIG. 5.

The present invention is shown in the partially cut away top view of FIG. 1 which shows two frame members 10 and 12 supporting a plurality of transversely-extending rods 14, 16, 18 and 20. The rod structure may be supported in the frame members 10 and 12 by any of a number of conventional fastening systems such as threaded screw or other quickly disengaging holding mechanisms. Primary consideration in designing the rod holding member in the frames 12 and 10 is for ease of assembly as well as ease of repair to be discussed later in conjunction with the remainder of the Figure.

The remainder of FIG. 1 illustrates the holding mechanism for the electrical heating element 22. The electrical resistive heating element 22 is a continuous section shown entering at the right hand side of FIG. 1. For descriptive purposes of the drawing which is in cut-away, the wire is not shown as being continuously wound throughout the entire system but in practice, 22 is a single continuous element which would be attached to an electrical source (not shown) which would heat the electrical wire 22. The heating wire 22 is composed of coil segments 24 alternating with straight line segments 26 illustrated at various positions on FIG. 1. Interspaced along the rods 14, 16, 18 and 20 are a series of ceramic spools 28 shown in detail in FIGS. 3 and 4. There is a single groove 29 shown in FIG. 4 in each of the ceramic spools 28. The straight wire segments 26 of the electrical resistive heating wire 22 are located in the groove 29 in each of the spools 28. Adjacent on each side of the spools 28 is a ceramic insulator 30 shown in FIGS. 5 and 6 which act as spacers to determine the distance between the adjacent spools. FIG. 1 illustrates a number of spacers 30 with varying lengths to indicate that the length of the spacer may be used to determine the number of spools and, therefore, the number of lengths of resistive heating wire which is would continuously between the frames 10 and 12. The insulative spacers 30 adjacent the spools 28 on the rods 14, 16, 18 and 20 abut the recessed portions 31 of each ceramic spool 28 on both sides of the spool as shown in FIG. 4.

The manner in which the straight line segments and the coils interact with the groove 29 of the spools 28 is shown in FIG. 2 taken along line 2—2 of FIG. 1 wherein it can be seen that the straight line segment 26 which is attached to the spool 28 of the rod 16 simply lays in the groove 29 whereas the straight section which surrounds the spools of the end rods 14 and 20 are bent around the spool 28 in the groove 29. Therefore, the wire may be designed so that the sections at each end of the frame structure have a longer straight line section so as to be better able to wrap around the spool on the end rods 14 and 20 in order to redirect the wire in the opposite direction.

Further, the straight line sections 26 of the heating wire 22 may be held in the groove position of each of the spools 28 by a tied off wire 32 as shown in FIG. 1. This tied off wire may be any conventional small gauge wire which can be used to hold the heating element 22 in the groove 29 of each spool 28. The only requirement being that the wire 32 be easily removed for purposes of repair or changing spacing locations.

In order to increase or decrease the distance between the spools or the distances between the rods or to change the heating wire elements, it is only necessary in the construction of the present invention to remove the rod sections 14, 16, 18 or 20, or merely to loosen at one end and slide off the spacers and spools to make whatever changes are necessary for repair purposes. The present modular construction of the heating element system permits the addition of further frame segments in either the horizontal or vertical direction or the stacking of frame sections.

In an alternate embodiment, the rods could be vertically offset or a second complete layer of rods vertically offset from the first layer could be used with the coil sections 24 extending vertically from the top row of rods to the bottom row of rods and then back up to the top row of rods. This vertical offset construction acts as an alternative to the stacking method and permits the use of a plug element to its greatest advantage when the air flow is directed transverse to the wound coil sections 24. That is, when the air flow enters from the side perpendicular to the coil sections which extend vertically downward in the alternate embodiment, there is the least air flow resistance due to frame structure and this permits a greater mass air flow, thus improving the kilowatt per unit area output.

It may be appreciated that many changes and modifications may be made without departing from the spirit and scope of the present invention. Such modifications may include the offset positioning of rod locations either vertically or horizontally, multiple rod locations with different spool offsets, greater or lesser distances between rods with greater lengths of wound coil sections 24, and use of frame sections which permit greater passage of incoming air flow causing less pressure drop and greater kilowatt per unit output. Furthermore, the spacers and spools which are located upon rods may be otherwise modified to interact with each without the use of a rod. Therefore, the scope of the present invention should be measured only by the following claims.

What is claimed is:

1. An improved electrical heating element providing for an increased amount of electrical wire per unit space for plug-type convection heaters comprising:

an elongated generally rectangular-shaped metal frame structure opened at its ends and having a pair of laterally spaced apart support elements defining the longer sides of the rectangle, each support element extending parallel to the direction of the longitudinal axis of the frame structure and being of generally rectangular transverse cross section throughout its longitudinal extent;

a pair of removable end rods made from metal extending through said support elements from one side of the frame structure to the other side thereof in a direction generally perpendicular to the longitudinal axis of the structure;

a plurality of removable intermediate rods made from metal located between and arranged parallel to said pair of end rods, said intermediate rods extending through said support elements from said one side of the frame structure to the other side; the spacing between a pair of adjacent rods being equal to provide for air flow therethrough;

fastening means carried by said support elements for removably connecting said end and intermediate rods to said support elements;

a plurality of ceramic spools each of circular configuration spaced along each of said end and intermediate rods; each spool being provided with an annular endless groove midway between the end faces thereof; each of the end faces of each spool being provided with an annular recess forming an abutment stop surface; each spool having a centrally located opening through said end faces through which the corresponding metal rod extends;

a plurality of ceramic insulating spacers on each of said end and intermediate rods, each spacer being of generally cylindrical configuration and having an axially extending bore so that the spacer may be slidably attached along one of said intermediate and metal rods; a pair of said spacers being positioned on opposite sides of said spools to space said spools from said support elements; the end portion of a spacer opposite a spool being received in the annular recess and abutting the corresponding abutment stop surface;

a continuous electrical resistance heating wire having coil wound segments separated by straight wire segments, with the straight wire segments of said wire being located and retained in the grooves of said spools; and clamping retaining wires for tying the straight wire segments of said wire to said spools.

* * * * *